US010085085B2

(12) United States Patent
Chute et al.

(10) Patent No.: US 10,085,085 B2
(45) **Date of Patent: *Sep. 25, 2018**

(54) HEADPHONE

(71) Applicant: Bose Corporation, Framingham, MA (US)

(72) Inventors: George Chute, Milford, MA (US); Eric Wallace, Andover, MA (US); Michael Ting, Boston, MA (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/422,341

(22) Filed: Feb. 1, 2017

(65) Prior Publication Data

US 2018/0220223 A1 Aug. 2, 2018

(51) Int. Cl.
*H04R 1/10* (2006.01)
*H04R 5/033* (2006.01)

(52) U.S. Cl.
CPC ..... *H04R 1/1066* (2013.01); *H04R 1/105* (2013.01); *H04R 1/1008* (2013.01); *H04R 1/1058* (2013.01); *H04R 5/033* (2013.01); *H04R 5/0335* (2013.01)

(58) Field of Classification Search
CPC .... H04R 1/46; H04R 2460/13; H04R 25/606; H04R 1/1066; H04R 1/105; H04R 1/1008; H04R 1/1058; H04R 5/033; H04R 5/0335
USPC ..... 381/371
See application file for complete search history.

(56) References Cited

U.S. PATENT DOCUMENTS 4,747,145 A * 5/1988 Wiegel ..... H04M 1/05 381/378
5,109,424 A * 4/1992 Andre ..... H04R 1/1008 381/371
5,293,647 A 3/1994 Mirmilshteyn et al.
5,793,878 A * 8/1998 Chang ..... H04R 5/0335 381/370
6,542,615 B1 * 4/2003 Ito ..... H04R 1/1066 381/370
7,171,698 B2 * 2/2007 Saffran ..... A61F 11/14 2/209
9,226,060 B2 * 12/2015 Minarik ..... H04R 1/1066
2003/0210801 A1 * 11/2003 Naksen ..... H04R 1/1066 381/370
2009/0285435 A1 * 11/2009 Nelson ..... F16C 11/06 381/378
2011/0051976 A1 * 3/2011 Tsai ..... H04R 1/1066 381/378

(Continued)

OTHER PUBLICATIONS

The International Search Report and the Written Opinion of the International Searching Authority dated Apr. 18, 2018 in PCT Application No. PCT/US2018/016350.

*Primary Examiner* — Oyesola C Ojo
(74) *Attorney, Agent, or Firm* — Brian M. Dingman; Dingman IP Law, PC

(57) ABSTRACT

A headphone that includes a headband and one or two earcups. The earcups are movably coupled to the headband by a joint that is constructed and arranged to allow translation of the earcup relative to the headband along a translational axis, and rotation of the earcup from a neutral position in both directions about the translational axis, where in a first direction the rotation extends for at least about 90 degrees from the neutral position.

18 Claims, 12 Drawing Sheets

(56) References Cited

U.S. PATENT DOCUMENTS

| | | | | |
|---|---|---|---|---|
| 2011/0206216 | A1* | 8/2011 | Brunner | H04R 1/1066 381/74 |
| 2012/0099754 | A1 | 4/2012 | Petersen | |
| 2012/0140973 | A1* | 6/2012 | Olodort | H04R 1/1066 381/375 |
| 2014/0003646 | A1* | 1/2014 | Andersen | H04R 1/08 381/375 |
| 2014/0205129 | A1 | 7/2014 | Blair et al. | |
| 2014/0363012 | A1 | 12/2014 | Wolf et al. | |
| 2015/0131809 | A1* | 5/2015 | Jones | H04R 1/1041 381/74 |
| 2015/0139473 | A1 | 5/2015 | Jaynes | |
| 2016/0127819 | A1* | 5/2016 | Shiomi | H04R 1/1033 381/378 |
| 2016/0193085 | A1* | 7/2016 | Jenkins | A61F 11/14 381/367 |
| 2017/0019724 | A1* | 1/2017 | Cochran | H04R 1/1008 |

* cited by examiner

HEADPHONE

BACKGROUND

This disclosure relates to a headphone.

Headphones have one or two earcups. In order to be adjustable so as to comfortably fit most heads, the earcups should be able to rotate about the vertical axis. The earcups are sometimes also rotatable about a horizontal axis. The earcups should also be able to translate along the vertical axis. Many headphones use yokes to couple the earcups to the headband to help accomplish the necessary rotations and sliding movement, but yokes are relatively large and are not integral to the headband design. There is a need for an earcup-to-headband joint that provides for rotation and translation along the vertical axis, while allowing the earcups to fold flat against the headband and thus decrease the depth of the headphones and a headphone storage/carrying case.

SUMMARY

A headphone joint that is structured to allow rotation of each earcup relative to the headband about at least the vertical axis, and translation along the vertical axis. The rotation about the vertical axis extends for about 90 degrees in one direction, to allow the earcups to fold flat against the headband. The joint can be integral to the part of the headband and the part of the earcup that interface together. There is thus little or no outward evidence of the joint, unlike the case with headphones that use yokes to connect the headband to the earcups.

All examples and features mentioned below can be combined in any technically possible way.

In one aspect, a headphone includes a headband and an earcup. The earcup is movably coupled to the headband by a joint that is constructed and arranged to allow translation of the earcup relative to the headband along a translational axis, and rotation of the earcup from a neutral position in both directions about the translational axis, where in a first direction the rotation extends for at least about 90 degrees from the neutral position.

Embodiments may include one of the following features, or any combination thereof. The translation along the translational axis may extend for at least about 20 mm in both directions from the neutral position. In a second direction, the rotation about the translational axis may extend for at least about 10 degrees. The joint may be further constructed and arranged to allow rotation of the earcup from the neutral position in both directions about a horizontal axis that is orthogonal to the translational axis; the rotation about this horizontal axis may extend for at least about 10 degrees in both directions.

Embodiments may include one of the above and/or below features, or any combination thereof. The joint may include a pivot member that has a first end that is fitted in a generally partially-tubular slider of the headband, and a second end that defines an arc-shaped surface. The first end of the pivot member may be adapted to slide in the headband along the translational axis. The first end of the pivot member may be adapted to rotate within the slider about the horizontal axis. The earcup may include an earcup shell, and the rotation of the earcup about the translational axis may have end points that establish the end range of rotational motion in both directions; the end points may be defined by contact of the second end of the pivot member with the earcup shell. The first end of the pivot member may have a generally partially cylindrical sliding member that is received in the slider and is adapted to slide along the slider.

Embodiments may include one of the above and/or below features, or any combination thereof. The second end of the pivot member may be coupled to the first end of the pivot member such that the second end can pivot in both directions relative to the first end about a horizontal axis that is orthogonal to the translational axis. The second end of the pivot member may be coupled to the first end of the pivot member by a pin. The first end of the pivot member may include a generally partially spherical sliding member that is received in the slider and is adapted to slide along the slider and rotate side-to-side in the slider about a horizontal axis. The joint may have a bearing member that defines an arc-shaped interior bearing surface upon which the arc-shaped surface of the pivot member rides as the earcup is rotated about the translational axis. The headband may be constructed and arranged to push the arc-shaped surface of the pivot member against the interior bearing surface of the bearing member.

In another aspect, a headphone includes a headband and two earcups. Each earcup is movably coupled to the headband by a joint that is constructed and arranged to allow translation of the respective earcup relative to the headband along a translational axis, and rotation of the respective earcup from a neutral position in both directions about the translational axis, where in a first direction the rotation extends about the translational axis for at least about 90 degrees from the neutral position and in a second direction the rotation about the translational axis extends for at least about 10 degrees. Each joint is further constructed and arranged to allow rotation of the respective earcup from the neutral position in both directions about a horizontal axis that is orthogonal to the translational axis, wherein the rotation about the horizontal axis extends for at least about 10 degrees in both directions. Each joint comprises a pivot member that has a first end that is fitted in the headband and a second end that defines an arc-shaped surface, wherein the first end of the pivot member is adapted to slide in the headband along the translational axis, wherein each joint further comprises a bearing member that defines an arc-shaped interior bearing surface upon which the arc-shaped surface of the pivot member rides as the earcup is rotated about the translational axis. The headband is constructed and arranged to push the arc-shaped surface of the pivot member against the interior bearing surface of the bearing member.

Embodiments may include one of the above and/or below features, or any combination thereof. The headband may have two generally partially tubular sliders, and the first end of each respective pivot member may have a generally partially cylindrical sliding member that is received in a slider and is adapted to slide along the slider. The second end of each respective pivot member may be coupled to the first end of the pivot member such that the second end can pivot relative to the first end about a horizontal axis that is orthogonal to the translational axis.

In another aspect, a headphone includes a headband and two earcups. Each earcup is movably coupled to the headband by a joint that is constructed and arranged to allow translation of the respective earcup relative to the headband along a translational axis in both directions from a neutral position, rotation of the respective earcup from the neutral position in both directions about the translational axis, with on such rotation extending for about 90 degrees, and rotation of the respective earcup from the neutral position about a horizontal axis that is orthogonal to the translational axis.

Embodiments may include one of the above and/or below features, or any combination thereof. Each joint may comprise a pivot member that has a first end that is fitted in the headband and a second end that defines an arc-shaped surface, wherein the first end of the pivot member is adapted to slide in the headband along the translational axis. The headband comprises a pair of generally partially tubular sliders. The first end of each pivot member comprises a generally partially cylindrical sliding member that is received in a slider and is adapted to slide along the slider. The second end of each pivot member is coupled to the first end of the pivot member such that the second end can pivot relative to the first end about a horizontal axis that is orthogonal to the translational axis. Each joint may also include a bearing member that defines an arc-shaped interior bearing surface upon which the arc-shaped surface of the pivot member rides as the earcup is rotated about the translational axis, wherein the headband is constructed and arranged to push the arc-shaped surface of each pivot member against the interior bearing surface of a bearing member.

DETAILED DESCRIPTION

A headphone refers to a device that fits around, on, or in an ear, and that radiates acoustic energy into the ear canal. Headphones are sometimes referred to as earphones, earpieces, headsets, earbuds, or sport headphones, and can be wired or wireless. A headphone includes an acoustic driver to transduce audio signals to acoustic energy. The acoustic driver may be housed in an earcup. While some of the figures and descriptions following show a single headphone, a headphone may be a single stand-alone unit or one of a pair of headphones (each including a respective acoustic driver and earcup), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality, such as a microphone so that they can function as a headset.

In an around or on the ear headphone, the headphone may include a headband and at least one earcup that is arranged to sit on or over an ear of the user. In order to accommodate heads of different sizes and shapes, the earcups need to be able to pivot about at least the vertical axis, and they need to translate for some distance along the vertical axis. The headband can be collapsible or foldable, and can be made of multiple parts. Some headbands include sliders, which may be positioned internal to the headband, that provide for the necessary translation of the earcups. Some headphones include a yoke pivotally mounted to the headband, with the earcups pivotally mounted to the yoke, to provide for the necessary rotation of the earcups.

The headphones of the present disclosure have a joint that couples the earcup(s) to the headband. The joint is structured to allow constrained rotation of the earcups relative to the headband about at least the vertical axis, and in some cases also a perpendicular horizontal axis. The joint is also structured to provide for constrained translation along the vertical axis. Rotation about a vertical axis extends to 90 degrees in one rotational direction, so that the earcups can be folded flat against the headband, anywhere along their translational motion. Thus, the joint described herein allows the headphones to be folded flat, which allows a headphone storage case to be flatter than could otherwise be achieved without the joint.

Figure 1:
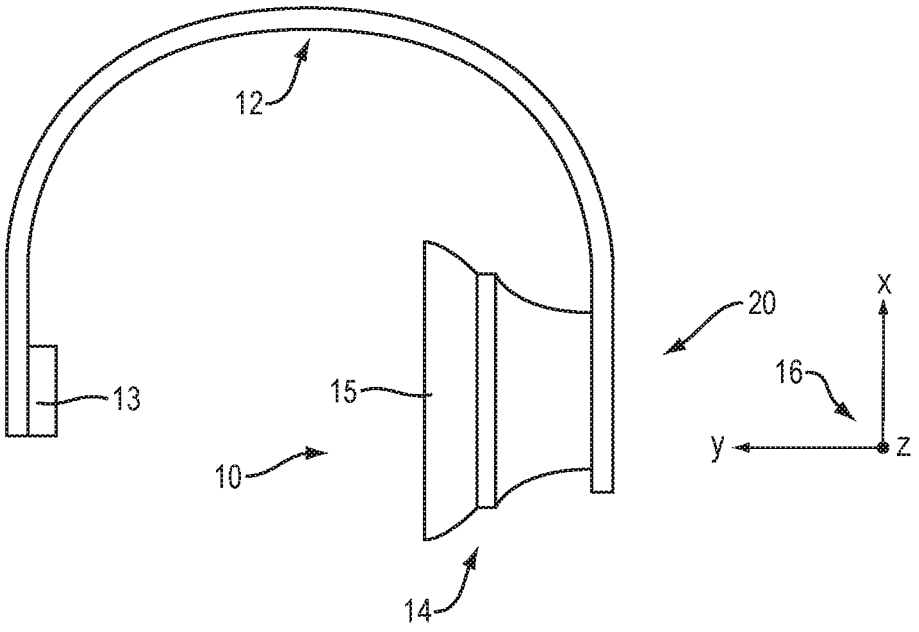
FIG. 1 is front view of a headphone.
Figure 2:
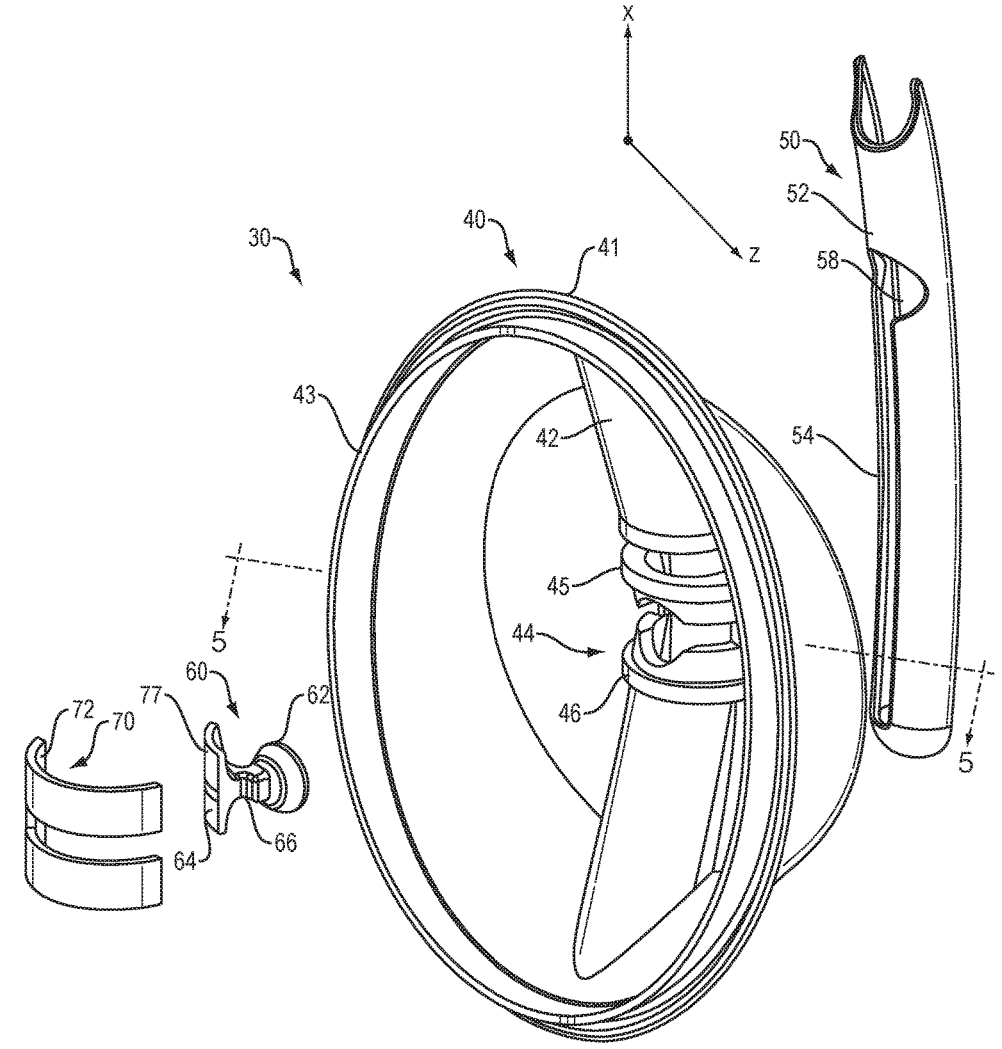
FIG. 2 is an exploded view of an earcup, and a joint that movably couples the earcup to the headband.

Headphone 10 is shown in FIG. 1. Headphone 10 includes earcup 14 that is carried by headband 12, which is adapted to be fitted on and over the user's head. Cushion 13 is depicted, to schematically represent cushioning that may be present in some headphones. Cushions may increase user comfort. Earcup 14 is movably coupled to headband 12 by joint 20. Joint 20 is constructed and arranged to allow translation of earcup 14 up and down along vertical or translational axis X. Joint 20 is further constructed and arranged to allow rotation of earcup 14 from the neutral position shown in FIG. 1, in both directions about translational axis X. In one of these rotational directions the rotation extends for approximately 90 degrees, such that the open face of ear cushion 15 of earcup 14 faces either forward or backward, rather than facing inward (i.e., toward the location of the user's head (not shown)). This rotation folds the headphone "flat," wherein the height of the headphone (i.e., its extent along the Z axis) equals the height of the earcup plus headband. In one example, this fold-flat height is approximately 54 mm. This fold-flat height is less than the height that the headphones have when the earcup is not rotated about the X axis, which would equal the diameter of the earcup; in the example of this same headphone this height would be approximately 79 mm. Since the fold-flat configuration decreases the height of the headphones, the headphone carrying case can be thinner. The fold-flat aspect of the present headphones thus decreases the bulkiness of the carrying case, which makes the headphones easier to store, pack and carry.

FIGS. 2-5 provide pertinent details of one non-limiting example of an implementation of the joint that is constructed and arranged to allow translation of the earcup up and down along vertical or translational axis X, as well as rotation of the earcup in both directions about translational axis X, with rotation in one of these rotational directions extending for approximately 90 degrees. Joint 30 includes pivot member 60 that has first end 62. End 62 is received by slider 50, which is part of joint 30 and is located within the headband (not shown). Slider 50 comprises U-shaped, partially tubular body 52. Pivot member 60 also has second end 64. In this example, the distal surface of end 64 defines an arc-shaped surface 77. Integral connecting portion 66 connects pivot member first end 62 and second end 64.

Figure 3:
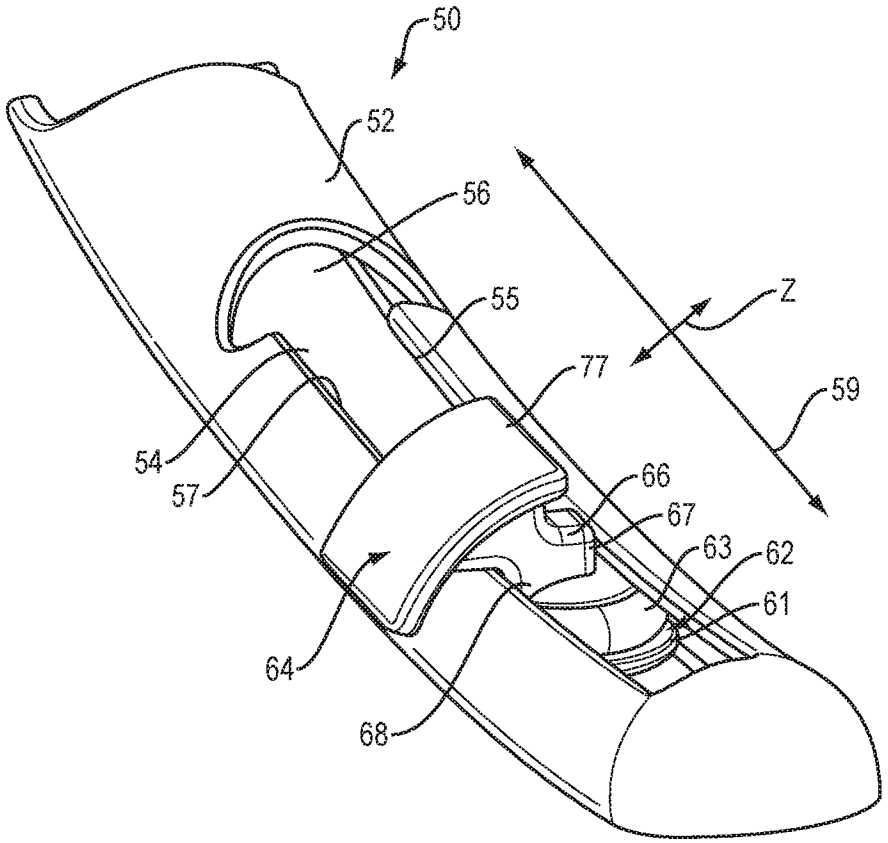
FIG. 3 shows parts of the assembled joint.

Slider 50 fits into slider receptacle groove 42 on the outside of shell body 41 of earcup shell 40. Slot 44 in groove 42, which is bounded by raised ridges 45 and 46, is sized and shaped to allow pivot member 60 to be nested into shell body 41, such that end 62 fits through enlarged opening 56 of slider slot 54. Slot 54 is narrower that the diameter of (generally spherical) end 62. This construction retains end 62 in slider 50. As shown in FIG. 3 (which leaves out the earcup shell for the sake of clarity), when the pivot member and slider are assembled, end 62 sits against the interior of slider body 52. Surface 77 of second end 64 projects from slider 50. As best shown in conjunction with FIG. 4, connecting portion 66 of pivot member 60 has ends 67 and 68 that sit against edges 55 and 57 of slider slot 54 (FIG. 3); this inhibits pivot member 60 from pivoting within slider 50 about axis 59 (which is the translational axis that corresponds to axis X, FIG. 1).

Figure 4:
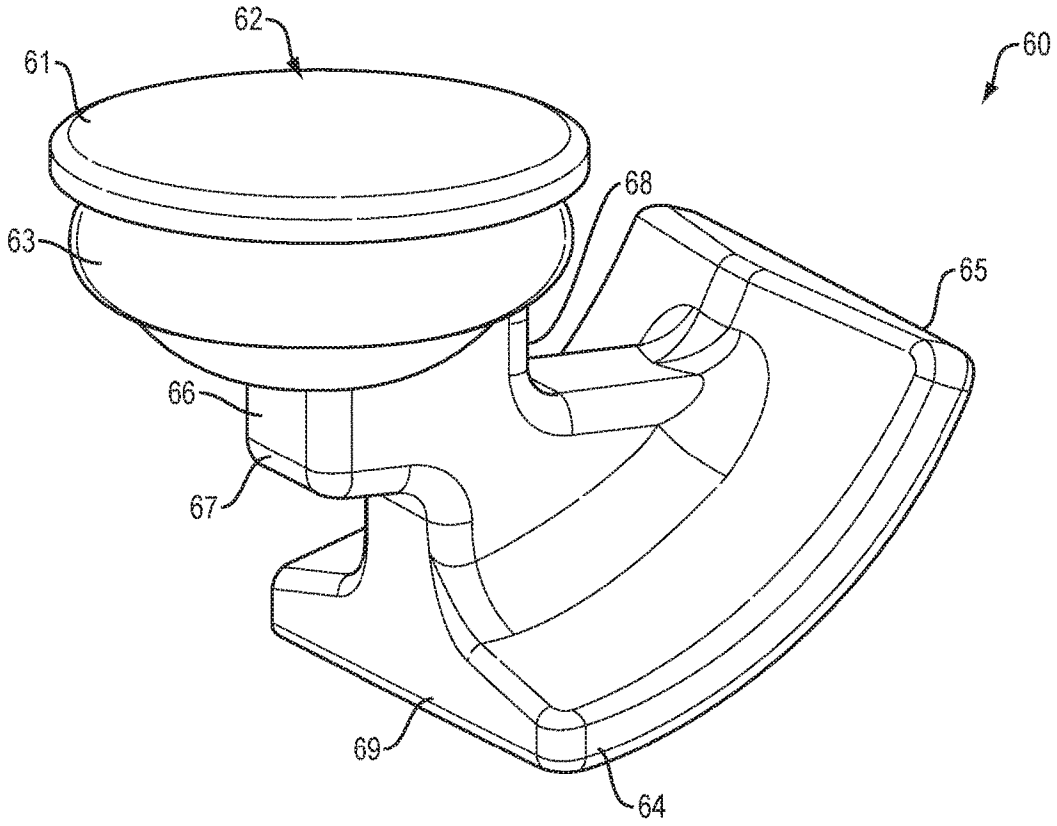
FIG. 4 shows the pivot member of FIG. 3.

As shown in FIG. 4, first end 62 includes generally disc-shaped retaining end member 61, which has a slightly greater diameter than O-ring 63. As shown in FIG. 3, O-ring 63 is fitted against the inside of slider body 52, and thus creates some friction that allows the slider to slide along axis 59, with some resistance. Slider slot 54 can be at least about 40 mm long, to allow for sliding of the earcup along the X axis of at least about 20 mm up and down from a neutral (centered) position. End 62 can pivot in both directions about the Z (horizontal) axis, until disc 61 contacts the interior of slider body 52. In one non-limiting example, the rotation about the Z axis extends for up to approximately 10 degrees from a centered (neutral) position, although smaller or greater rotations can be provided for by proper construction of the joint. The rotation about the Z axis allows the earcup to adjust relative to the headband, to accommodate different sized and shaped heads.

The rotations of the earcup about the X axis are accommodated by arc-shaped surface 77 of pivot member 60 and the arc-shaped interior bearing surface 72 of bearing member 70. See FIG. 2. As described above, pivot member 60 is held in slider 50 such that pivot member 60 cannot rotate about the X axis relative to slider 50. Bearing member 70 is coupled to earcup shell body 41 such that surface 77 sits on surface 72. This allows the earcup to be pivoted about the X axis.

Figure 5A:
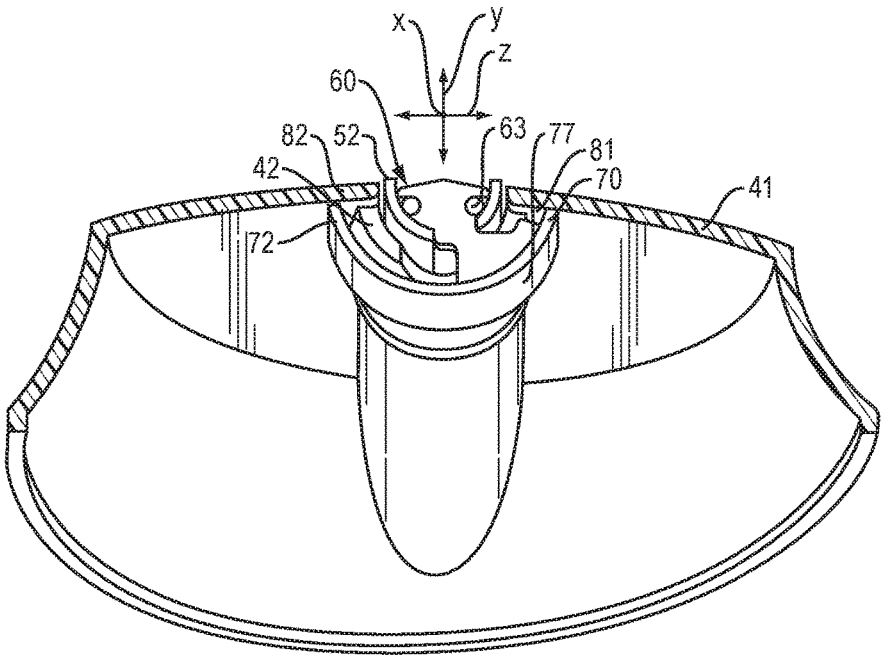
FIGS. 5A-5D are cross-sectional views taken along line 5-5 of FIG. 2 (but with the joint assembled) showing several rotational positions of the earcup relative to the slider.
Figure 5B:
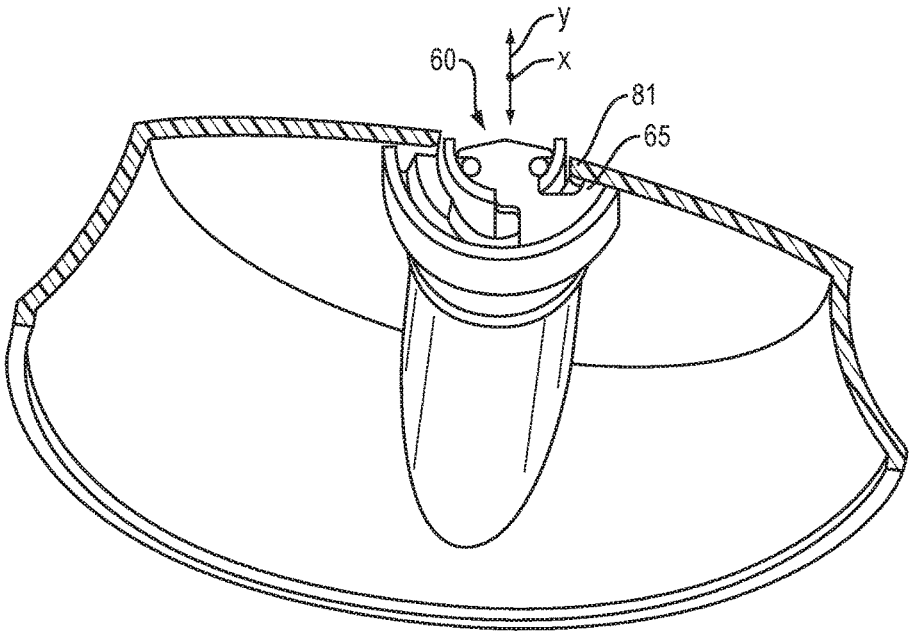
Figure 5D:
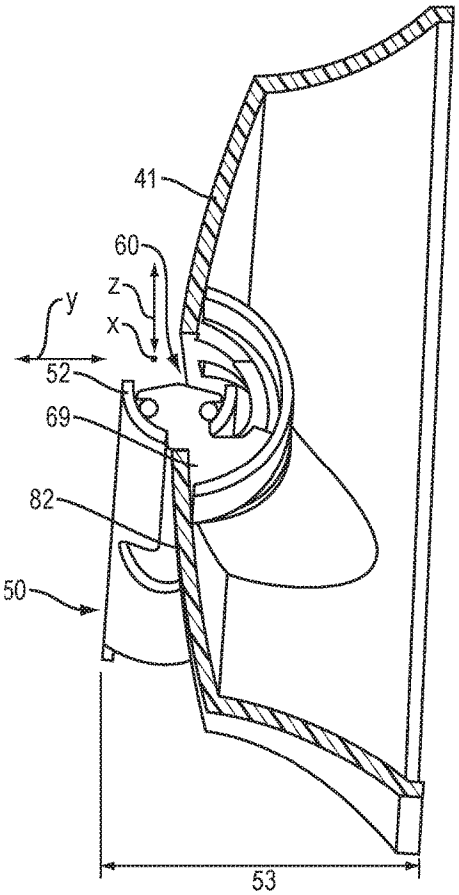
Figure 5C:
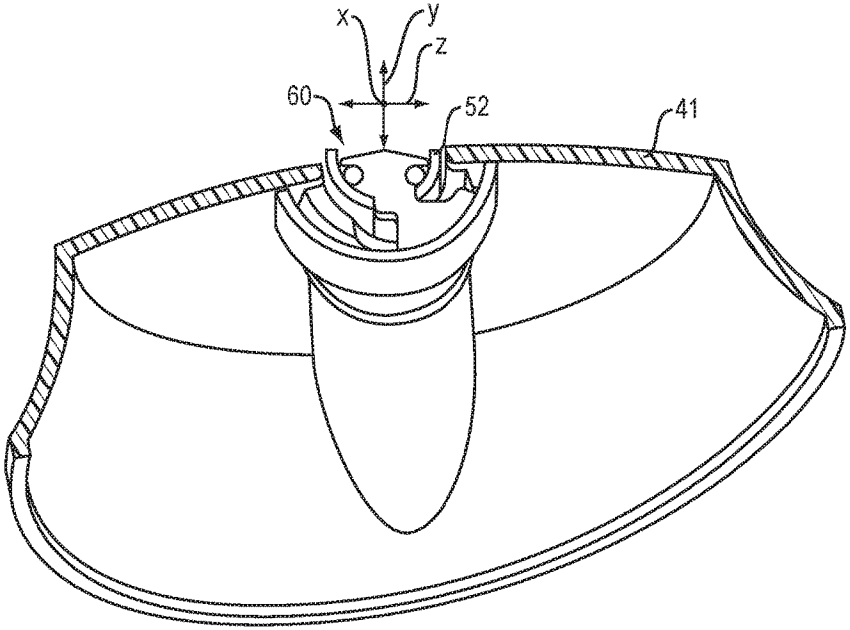
Figure 6:
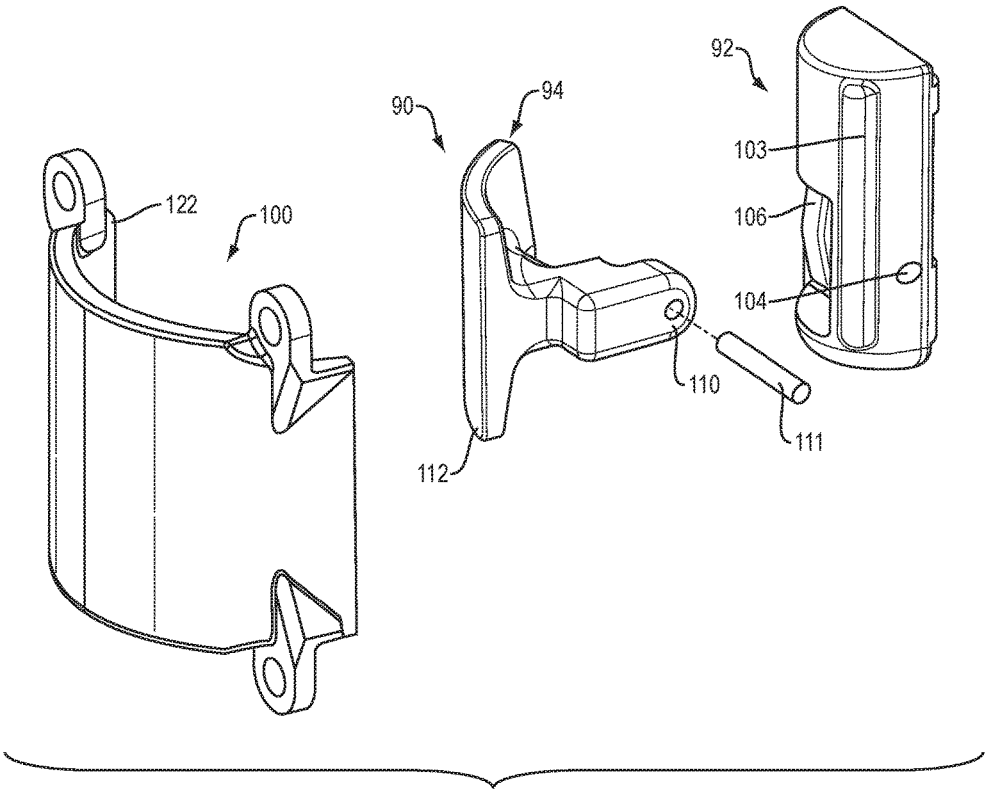
FIG. 6 is an exploded view of a pivot member and a bearing member of an alternative headphone joint.

In the non-limiting example depicted in FIGS. 2-5, joint 30 is constructed and arranged to allow for rotation in a first direction about the X axis (in FIGS. 5A-5D the translational (X) axis is into and out of the page), the rotation extending for about 10 degrees from a "neutral" position, and rotation of about 90 degrees in the other (a second) direction about the X axis. These rotations are illustrated in FIGS. 5A-5D, with FIG. 5A showing the "neutral" position (designated as zero degrees' rotation), FIG. 5B showing a −10 degree rotation (where the earcup is fully rotated in the first direction), FIG. 5C showing a +10 degree rotation (10 degrees from neutral in the second direction), and FIG. 5D showing a +90 degree rotation (where the earcup is fully rotated in the second direction).

In the neutral position shown in FIG. 5A the earcup is centered on the Y axis. Rotation about the X axis in the first direction can extend up to about 10 degrees as shown in FIG. 5B. The end-point is defined when end 65 of second end 64 of pivot member 60 contacts earcup shell body 41 (at point 81). As the earcup is rotated in the second direction it passes through the +10 degree location (FIG. 5C), to the second travel endpoint at +90 degrees (FIG. 5D), where end 69 of second end 64 of pivot member 60 contacts earcup shell body 41 (at point 82). In this +90 degree position the earcup lies along the Z axis, at right angles to the longitudinal axis of slider 50 (which corresponds to the X axis). The relative locations of the X, Y and Z axes are illustrated. As can be seen by comparing FIGS. 5A and 5D, this rotation to a "fold flat" position (FIG. 5D) substantially reduces the depth of the headphones (i.e., their extent along the Z axis), from the diameter of the earcup (FIG. 5A), to the depth of the earcup plus about half the diameter of the slider (distance 53, FIG. 5D). This substantially reduces the height needed in an earphone storage case, and thus reduces the size and bulk of the case.

An alternative pivot member/bearing member assembly 90 is depicted in FIGS. 6-9. Pivot member 90 in this case is made from two separate portions—first end 92 and second end 94. The first and second ends are interconnected via attachment structure 110 and attachment structure 106 being positioned such that their holes are aligned, with pivot pin 111 passing through opening 104 in end 92 and through holes in structures 106 and 110. This allows end 94 to pivot relative to end 92. This pivoting is about the Z axis (FIG. 1), and helps to accommodate different shapes and sizes of heads. In one non-limiting example this pivoting extends for about 10 degrees in either rotational direction from the "neutral" position depicted in FIG. 1. Other degrees of rotation can be accomplished by proper construction of ends 92 and 94 in a manner that would be apparent to one skilled in the art.

Figure 7:
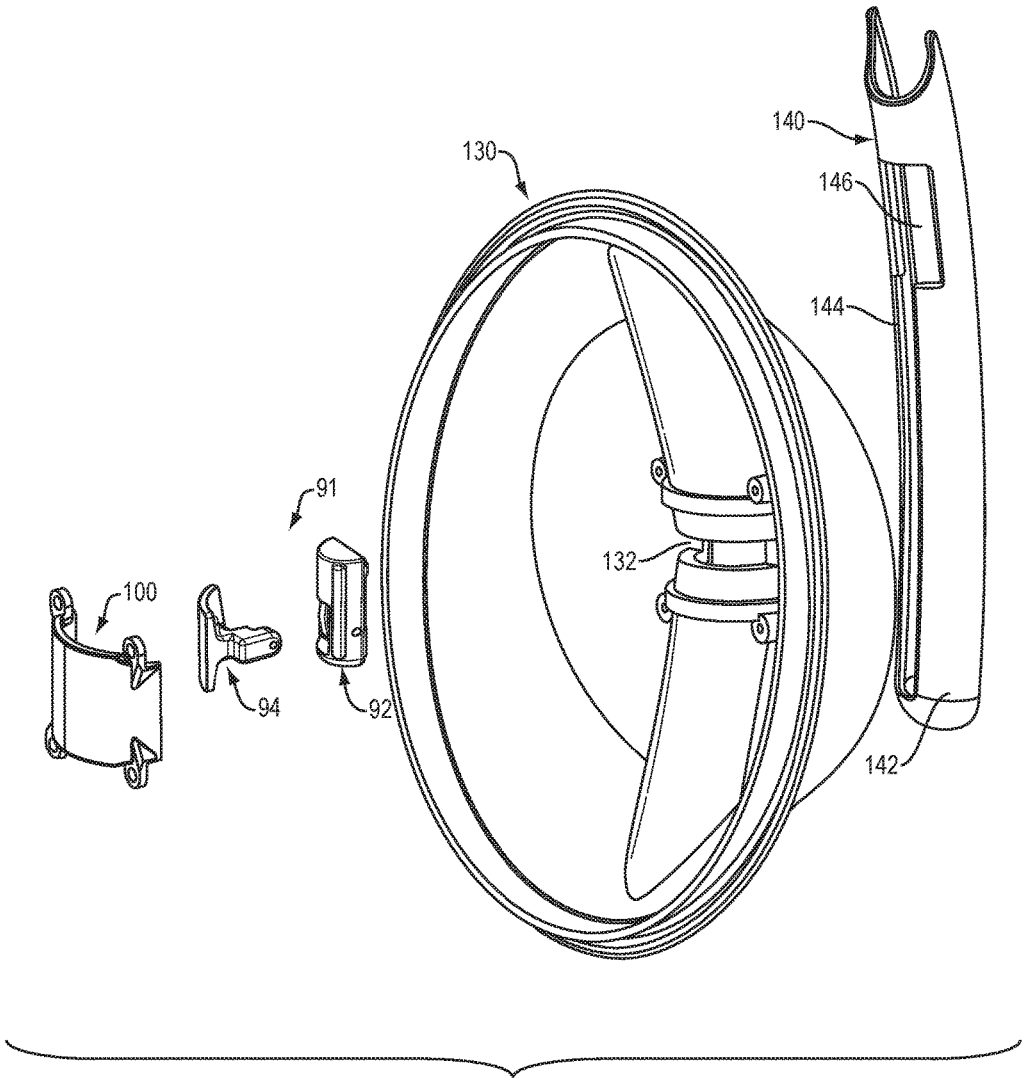
FIG. 7 is an exploded view of an earcup, a slider and the joint of FIG. 6 that movably couples the earcup to the headband.
Figure 8:
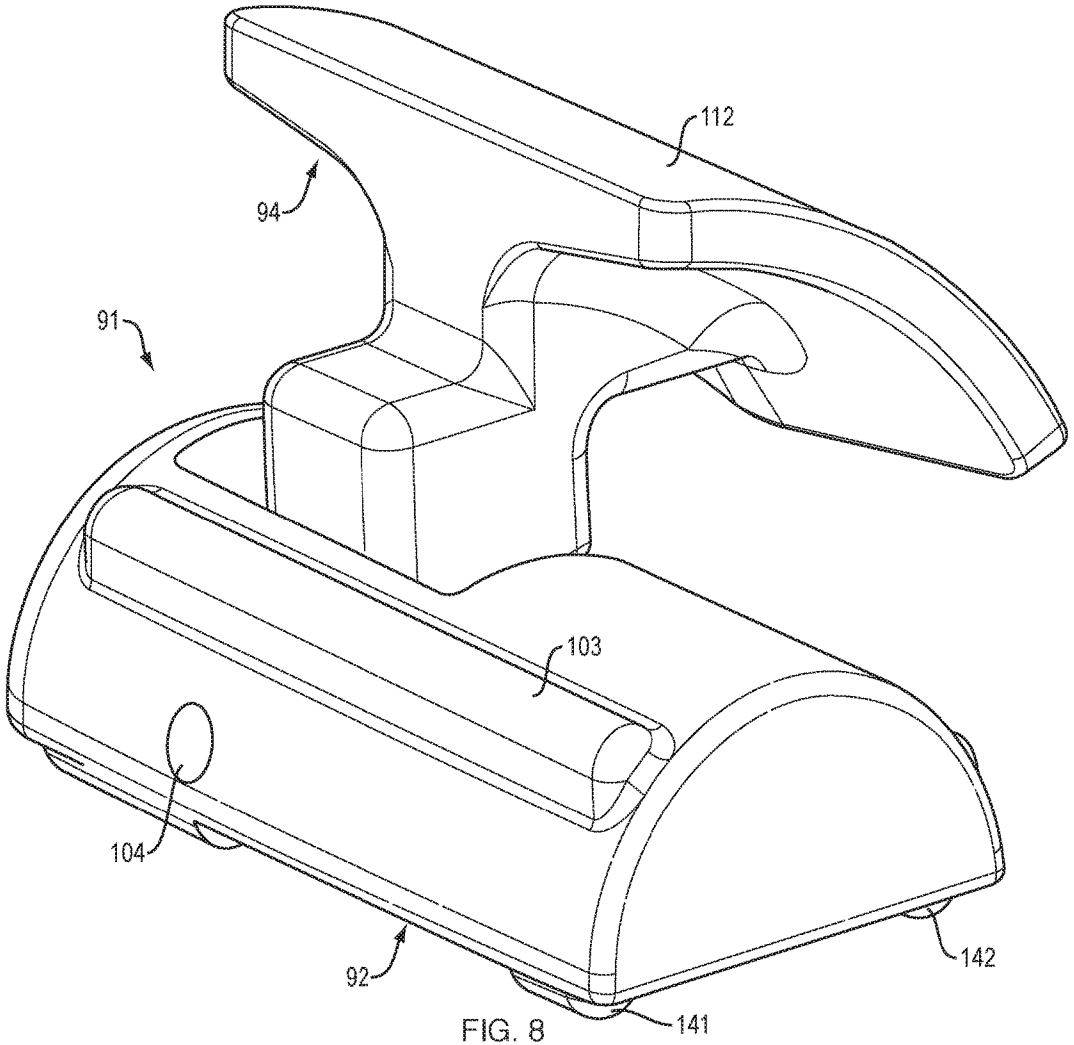
FIG. 8 shows the assembled pivot member of FIGS. 6 and 7.
Figure 9:
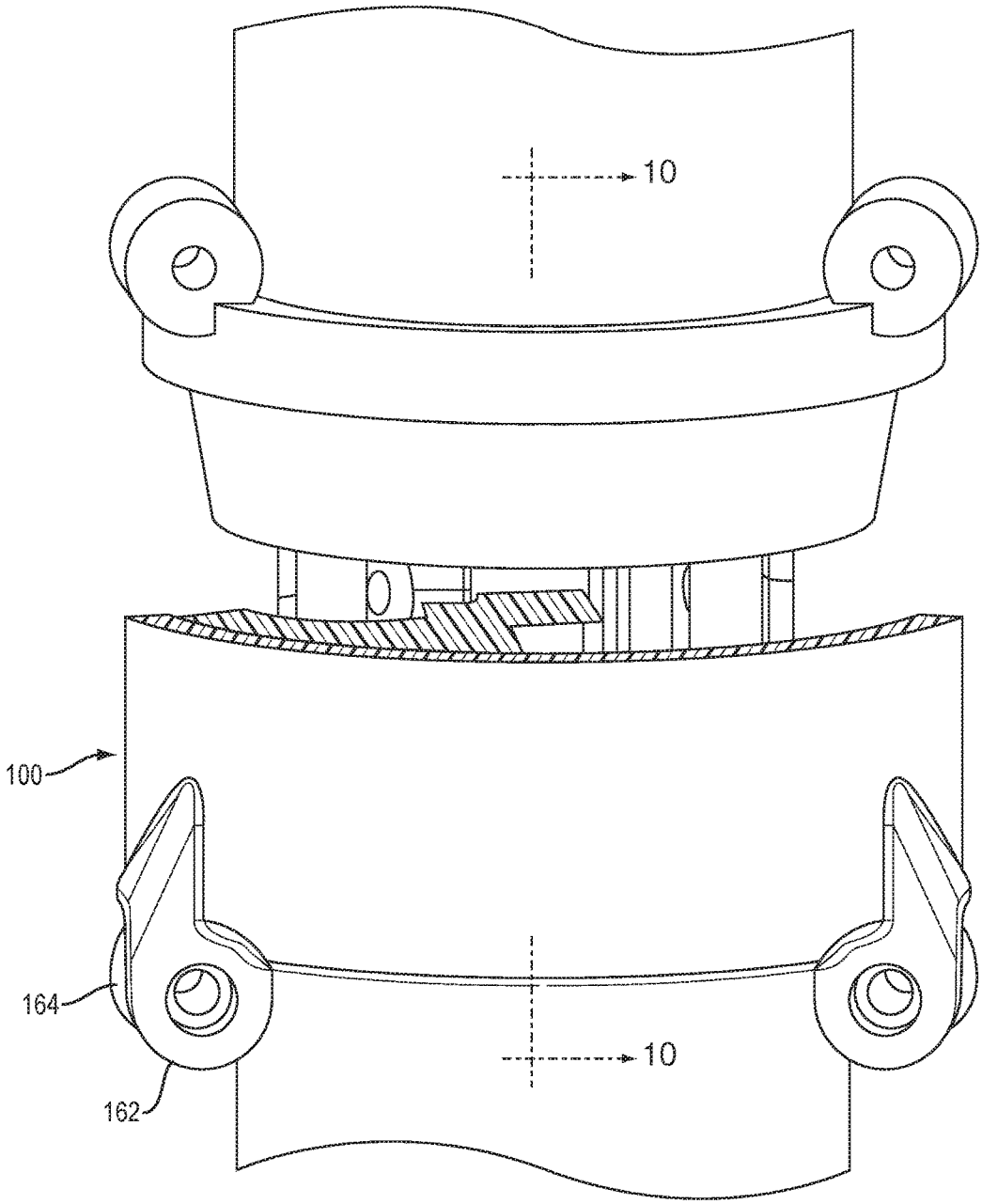
FIG. 9 is an enlarged, partial, cut-away view of an earcup/slider/pivot member assembly.

First end 92 includes one or more rubber strips or portions (such as strips 103, 141 and 142, FIG. 8) that provide the frictional fit in the slider 140, in a similar manner to O-ring 63. As shown in FIG. 7, slider 140 includes slider body 142 with slot 144, and slot opening 146. Second pivot member end 94 includes arc-shaped surface 112 that rides on arc-shaped interior bearing surface 122 of bearing member 100. Earcup shell 130 includes slot 132, which has a construction that is very similar to the embodiment shown in FIG. 2. Bearing member 100 is mounted inside of earcup shell 130 via four tabs (tab 162 numbered) that overlie mating pads that are part of the earcup shell (pad 164 numbered), using fasteners such as screws. See FIG. 9.

Figure 10A:
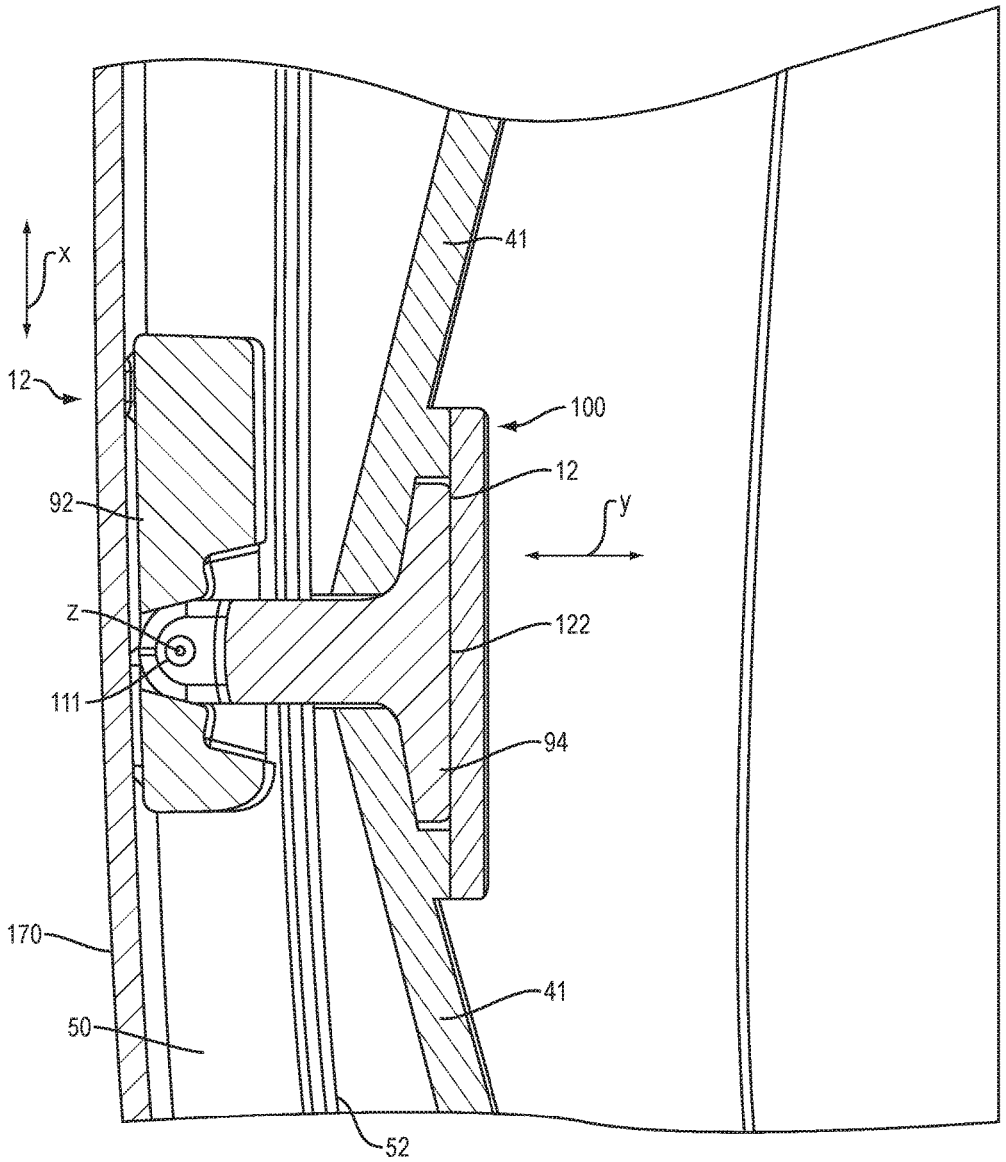
FIG. 10A is a partial cross-sectional view taken along line 10-10 of FIG. 9.
Figure 10B:
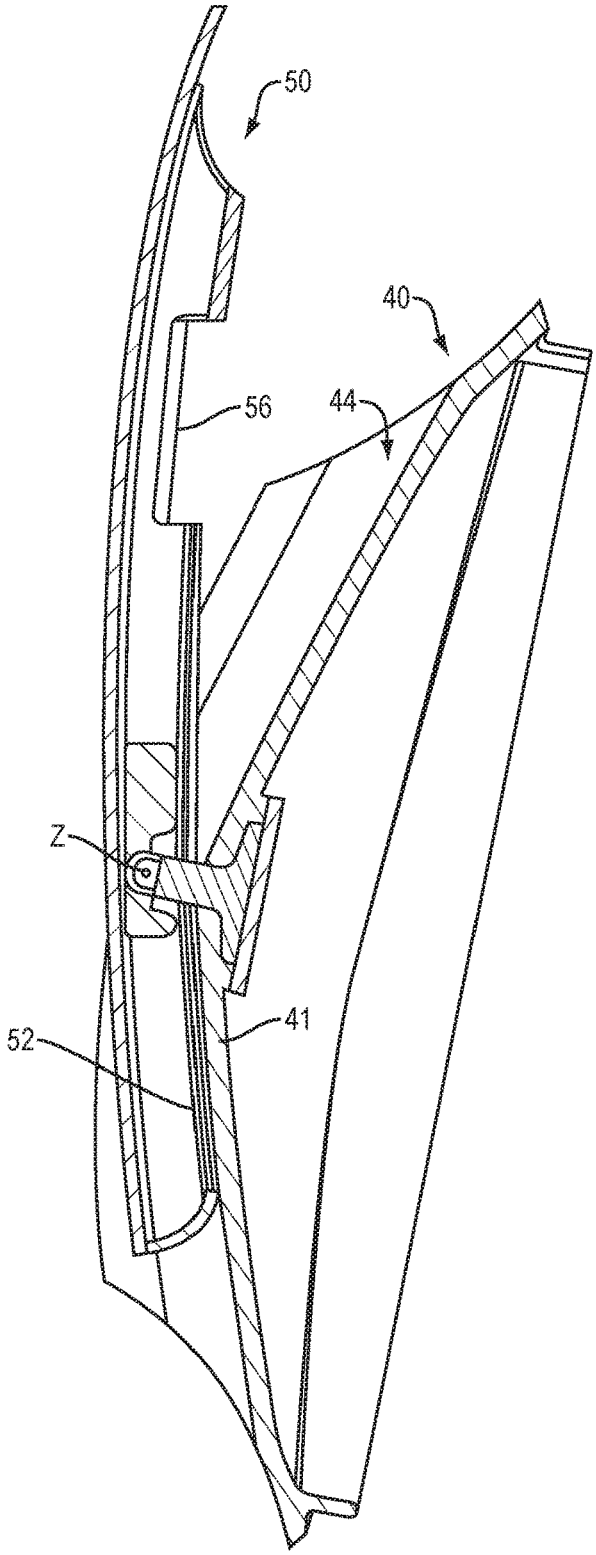
FIG. 10B is a cross-sectional view taken along line 10-10 of FIG. 9.

Constrained rotations about the Z axis can be accomplished in the manner illustrated in FIGS. 10A and 10B. The Z axis is coincident with the center of pin 111. Pivot member second end 94 can rotate up and down about the Z axis, relative to first end 92, which is held in slider 50. FIG. 10A illustrates the neutral position, in which the earcup is centered on the Y axis. Spring steel portion 170 of headband 12 pushes first end 92 toward bearing member 100, which is fixed to the inside of earcup shell body 41. This force also pushes second end 94 against bearing member 100, such that surface 112 rides on surface 122. The spring force thus provides for smooth rotational motion about the X axis.

FIG. 10B illustrates the farthest downward extent of rotation of earcup 40 about the Z axis, which can be approximately 10 degrees in one non-limiting example. The rotation end point (in both directions) occur when earcup shell body 41 of slot 44 contacts slider body 52. Slot 44 and slider body 52 can have the same radius of curvature to facilitate the +/−10 degree rotations, but they do not need to have the same radius of curvature.

A number of implementations have been described. Nevertheless, it will be understood that additional modifications may be made without departing from the scope of the inventive concepts described herein, and, accordingly, other embodiments are within the scope of the following claims.

What is claimed is:

1. A headphone, comprising:

an elongated headband comprising a partially tubular slider having a length and with an open interior, wherein the headband lies along a translational axis; and an earcup;

wherein the earcup is movably coupled to the headband by a joint that is constructed and arranged to allow translation of the earcup relative to the headband along the translational axis, and rotation of the earcup from a neutral position in both directions about the translational axis, where in a first direction the rotation extends for at least about 90 degrees from the neutral position;

wherein the joint comprises a pivot member that comprises a first end located in the interior of the slider and a second end located in the earcup, wherein the first end of the pivot member is adapted to slide in and along the length of the slider along the translational axis.

2. The headphone of claim 1, wherein in a second direction the rotation about the translational axis extends for at least about 10 degrees.

3. The headphone of claim 1, wherein the joint is further constructed and arranged to allow rotation of the earcup from the neutral position in both directions about a horizontal axis that is orthogonal to the translational axis.

4. The headphone of claim 3, wherein the rotation about the horizontal axis extends for at least about 10 degrees in both directions.

5. The headphone of claim 1, wherein the translation extends for at least about 20 mm in both directions from the neutral position.

6. The headphone of claim 1, wherein the second end of the pivot member defines an arc-shaped surface.

7. The headphone of claim 1, wherein the earcup comprises an earcup shell, and wherein the rotation of the earcup about the translational axis has end points that establish the end range of rotational motion in both directions, where the end points are defined by contact of the second end of the pivot member with the earcup shell.

8. The headphone of claim 1, wherein the first end of the pivot member comprises a generally partially cylindrical sliding member that is adapted to slide in and along the length of the slider along the translational axis.

9. The headphone of claim 1, wherein the second end of the pivot member is coupled to the first end of the pivot member such that the second end can pivot in both directions relative to the first end about a horizontal axis that is orthogonal to the translational axis.

10. The headphone of claim 9, wherein the second end of the pivot member is coupled to the first end of the pivot member by a pin.

11. The headphone of claim 1, wherein the first end of the pivot member comprises a generally partially spherical sliding member that is adapted to slide in and along the length of the slider along the translational axis and rotate side-to-side in the slider about a horizontal axis that is orthogonal to the translational axis.

12. The headphone of claim 6, wherein the joint further comprises a bearing member in the earcup that defines an arc-shaped bearing surface upon which the arc-shaped surface of the pivot member rides as the earcup is rotated about the translational axis.

13. The headphone of claim 12, wherein the headband is constructed and arranged to push the arc-shaped surface of the pivot member against the arc-shaped bearing surface of the bearing member.

14. A headphone, comprising:

an elongated headband having a length and lying along a translational axis; and two earcups, wherein each earcup is movably coupled to the headband by a joint that is constructed and arranged to allow translation of the respective earcup relative to the headband along the translational axis, and rotation of the respective earcup from a neutral position in both directions about the translational axis, wherein a first direction the rotation extends about the translational axis for at least about 90 degrees from the neutral position and in a second direction the rotation about the translational axis extends for at least about 10 degrees;

wherein each joint is further constructed and arranged to allow rotation of the respective earcup from the neutral position in both directions about a horizontal axis that is orthogonal to the translational axis, wherein the rotation about the horizontal axis extends for at least about 10 degrees in both directions;

wherein each joint comprises a pivot member that comprises a first end that is located in the headband and a second end that is located in the earcup and defines an arc-shaped surface, wherein the first end of the pivot member is adapted to slide in and along the length of the headband along the translational axis, wherein each joint further comprises a bearing member in the earcup that defines an arc-shaped bearing surface upon which the arc-shaped surface of the pivot member rides as the earcup is rotated about the translational axis; and wherein the headband is constructed and arranged to push the arc-shaped surface of the pivot member against the arc-shaped bearing surface of the bearing member.

15. The headphone of claim 14, wherein the headband comprises two generally partially tubular sliders having lengths and with open interiors, and the first end of each respective pivot member comprises a generally partially cylindrical sliding member that is located in the interior of a slider and is adapted to slide in and along the length of the slider along the translational axis, wherein the second end of each respective pivot member is coupled to the first end of the pivot member such that the second end can pivot relative to the first end about a horizontal axis that is orthogonal to the translational axis.

16. A headphone, comprising:

an elongated headband comprising two partially tubular sliders having lengths and with open interiors, wherein the sliders each lies along one of two translational axes; and two earcups;

where each earcup is movably coupled to the headband by a joint that is constructed and arranged to allow translation of the respective earcup relative to the headband along one of the translational axes in both directions from a neutral position, rotation of the respective earcup from the neutral position about a horizontal axis that is orthogonal to the translational axis, and rotation of the respective earcup from the neutral position in both directions about the translational axis, where in a first direction the rotation about the translational axis extends for at least 90 degrees from the neutral position;

wherein each joint comprises a pivot member that comprises a first end that is located in the interior of a slider and a second end located in the earcup, wherein the first end of each pivot member is adapted to slide in and along the length of the slider along the translational axis.

17. The headphone of claim 16, wherein the second end of each joint defines an arc-shaped surface located in an earcup, wherein the first end of each pivot member comprises a generally partially cylindrical sliding member that is adapted to slide in and along the length of the slider along the translational axis, wherein the second end of each pivot member is coupled to the first end of the pivot member such that the second end can pivot relative to the first end about a horizontal axis that is orthogonal to the translational axis.

18. The headphone of claim 17, wherein each joint further comprises a bearing member in an earcup that defines an arc-shaped bearing surface upon which the arc-shaped surface of the pivot member rides as the earcup is rotated about the translational axis, wherein the headband is constructed and arranged to push the arc-shaped surface of each pivot member against the arc-shaped bearing surface of the bearing member.

* * * * *